US005280842A

United States Patent [19]

Koo

[11] Patent Number: 5,280,842

[45] Date of Patent: Jan. 25, 1994

[54] LOW REVERSE TORQUE CLOSURE ASSEMBLY

[75] Inventor: James Y. C. Koo, Strasburg, Pa.

[73] Assignee: Kerr Group, Inc., Lancaster, Pa.

[21] Appl. No.: 991,053

[22] Filed: Dec. 15, 1992

[51] Int. Cl.[5] ..... B65D 55/02

[52] U.S. Cl. ..... 215/220

[58] Field of Search ..... 215/219, 220

[56] References Cited

U.S. PATENT DOCUMENTS

| | | | |
|---|---|---|---|
| 3,822,805 | 7/1974 | Marchant . | |
| 3,837,518 | 9/1974 | Gach . | |
| 3,853,236 | 12/1974 | Ostrowsky | 215/220 |
| 3,857,505 | 12/1974 | Mumford et al. | 215/220 |
| 3,863,796 | 2/1975 | Roy | 215/220 |
| 3,878,961 | 4/1975 | Curry et al. | 215/219 |
| 3,888,375 | 6/1975 | Gerk | 215/219 |
| 4,020,965 | 5/1977 | Northup | 215/213 |
| 4,284,201 | 8/1981 | Nixon | 215/220 |
| 4,319,690 | 3/1982 | Birrel et al. | 215/220 |
| 4,385,705 | 5/1983 | Kusz | 215/220 |
| 4,394,916 | 7/1983 | Smalley | 215/220 |
| 4,410,098 | 10/1983 | Dubs et al. | 215/220 |
| 4,480,759 | 11/1984 | Behrens et al. | 215/220 |
| 4,500,005 | 2/1985 | Forrester | 215/203 |
| 4,598,833 | 7/1986 | Herr | 215/220 |
| 5,020,681 | 6/1991 | Kunsz | 215/220 |

*Primary Examiner*—Allan N. Shoap
*Assistant Examiner*—Nova Stucker
*Attorney, Agent, or Firm*—Kenyon & Kenyon

[57] ABSTRACT

This invention relates to two-piece child resistant closures which utilize a ratchet feature to screw on the closure and, more specifically, to a two-piece child resistant closure wherein a particular ratchet configuration and placement of the elements thereof provides negligible reverse torque during undepressed counterclockwise rotation of the outer closure member. Negligible reverse torque is defined as the torque caused by frictional contact of the outer and inner cap members when the undepressed closure is turned in the removal direction is insufficient to cause the undesired or accidental removal of the closure from the container.

12 Claims, 6 Drawing Sheets

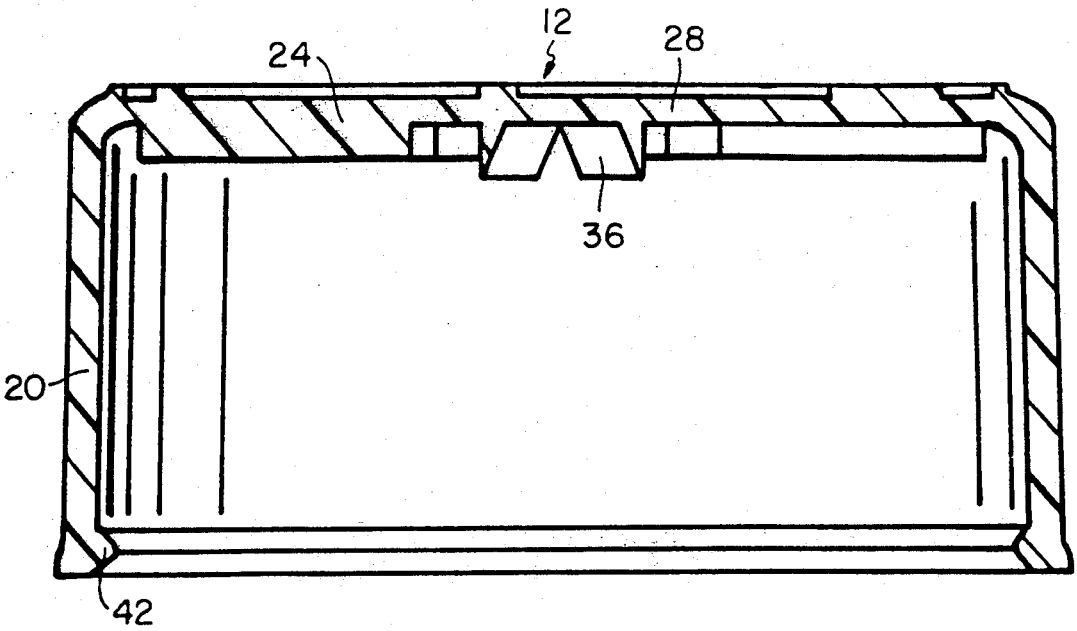
FIG. 3
FIG.9A
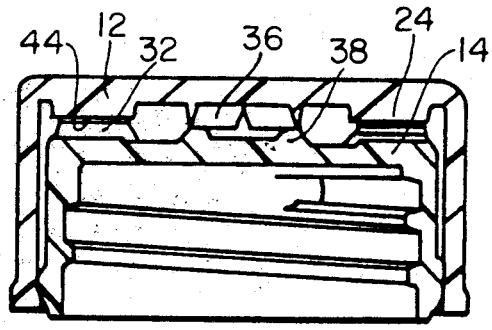
FIG.9B
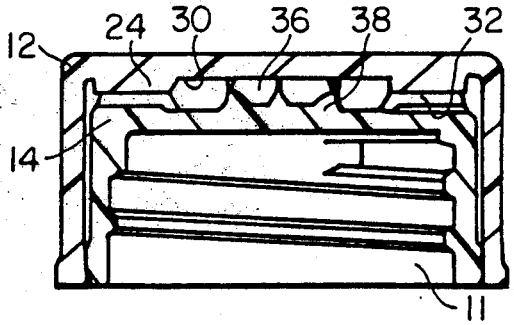
FIG.9C
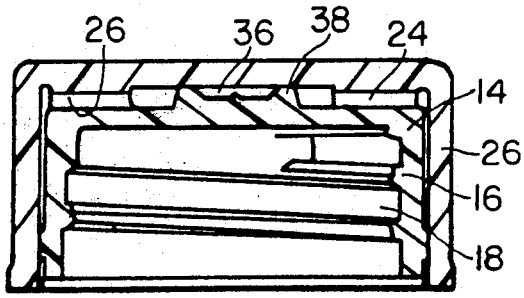

LOW REVERSE TORQUE CLOSURE ASSEMBLY

BACKGROUND OF THE INVENTION

This invention relates to two-piece child resistant closures which utilize a ratchet feature to screw on the closure and, more specifically, to a two-piece child resistant closure wherein a particular configuration and placement of the ratchet elements provides negligible reverse torque during undepressed counter-clockwise rotation of the outer closure member. Negligible reverse torque is defined as the torque caused by frictional contact of the outer and inner closure members when the undepressed closure is turned in the removal direction being insufficient to cause the undesired or accidental removal of the closure from the container.

Child resistant closures comprising two nested cap members are well known in the art. Typically, the inner and outer cap members of these closures are provided with cooperating sets of ratchet teeth which engage each other when the outer cap member is rotated in the direction to apply the closure to an associated container (usually the clockwise direction). When the outer cap member is rotated in the removal direction (typically counter-clockwise), these ratchet teeth cam or ratchet past each other on inclined surfaces, so that the closure generally cannot be removed by mere counter-clockwise rotation.

To provide positive engagement of the inner and outer closure members for removal, the known devices have employed sets of cooperating ratchet teeth or projections, which are normally held separated by a resilient or spring means. To remove these closures, the outer member must be variously squeezed, pushed, or otherwise manipulated to overcome the separating means, and bring the respective ratchet teeth into positive driving engagement.

The problem with known child resistant closures which utilize a ratchet feature to apply torque to screw on the closure is that this same feature must frictionally ride over itself under undepressed reverse torque of the closure to prevent unscrewing of the closure. In other words, all of the ratchet teeth on the inner and outer cap members must slide over one another. The frictional force created during this process is sometimes enough to unscrew the closure at low application torques. In other words, if the closure has not been relatively tightly placed on the container neck, it is possible that the closure may be accidentally and undesirably removed simply by virtue of the frictional force caused by the ratchet teeth sliding over one another during undepressed rotation of the outer cap member in the removal direction.

To assure that the ratchet teeth on the closure slide over one another without exerting sufficient torque or friction to unscrew the inner cap when the outer cap is turned in the removal direction, U.S. Pat. No. 3,776,407 to Cistone discloses the use of reduced thickness areas at the locations of the ratchet teeth of the outer ca to provide increased wall flexibility and a reduction in torque applied to the inner cap by the outer cap when the latter ratchets past the inner cap While the reduction in the skirt wall thickness is effective to increase the flexibility of the skirt in those areas and therefore generally accomplishes its intended purpose, the reduction of the thickness achieved by providing recessed areas in the outer wall circumferential surface has demonstrated some disadvantages, since the recessed areas necessarily result in a deviation from the desired overall circular configuration of the outer skirt surface.

Accordingly, it would be desirable to provide an improved closure assembly wherein the reverse torque resulting from the frictional force caused by the ratchet teeth sliding over one another is insufficient to affect removal of the closure.

ADVANTAGES AND SUMMARY OF THE INVENTION

It is an advantage of the present invention to provide a child proof closure that may not be removed from the associated container as a result of rotation of the outer cap member in the removal direction, unless the separating means are positively manipulated, such as by exerting downward force on the outer cap member.

It is another advantage of the present invention to provide a child proof closure wherein a particular ratchet configuration and placement of the elements thereof provides negligible reverse torque during undepressed counter-clockwise rotation of the outer closure.

It is still another advantage of the present invention to provide a child-resistant closure for sealing an open-topped container having an external screw thread formed on the neck of the container, the closure comprising an outer cap having a first top end wall and a first skirt depending from the outer edge thereof; an inner cap having a second top end wall and an internally threaded second skirt depending from the outer edge thereof for engagement with the external screw thread on the container, the outer cap overlying the inner cap and being concentric therewith; first ratchet teeth on a lower face of the first top end wall of the outer cap abutting with ramp members on the upper face of the second top end wall of the inner cap when the outer cap is turned in the application direction to rotate the two caps together and causing the internal threads on the inner cap to cooperate with the external screw threads on the container to fasten the closure on the container; the first ratchet teeth on the upper cap member abutting with second ratchet teeth on the inner cap member only when a downward force and a torque are simultaneously applied on the outer cap member to release the closure from the container; and the first ratchet teeth on the outer cap member sliding up and over the ramp members on the inner cap members with negligible back-ratchet torque when the outer cap member is turned in the removal direction without the application of a downward force on the outer cap member.

BRIEF DESCRIPTION OF THE DRAWINGS

The above and other features and advantages of the present invention will become apparent from the discussion hereinbelow of a specific, illustrative embodiment thereof presented in conjunction with the accompanying drawings, in which:

FIG. 3 is an elevational sectional view of the blank for the outer cap member of the closure;

FIG. 9 comprises three elevational sectional views (a)-(c) illustrating use of the closure of the present invention; and in particular, FIG. 9(*a*) illustrates the position of the closure elements when the outer cap member is undepressed, FIG. 9(*b*) illustrates the position of the closure elements during the torquing operation, and FIG. 9(*c*) illustrates the position of the closure elements during the untorquing operation.

DESCRIPTION OF A PREFERRED EMBODIMENT

Figure 1:
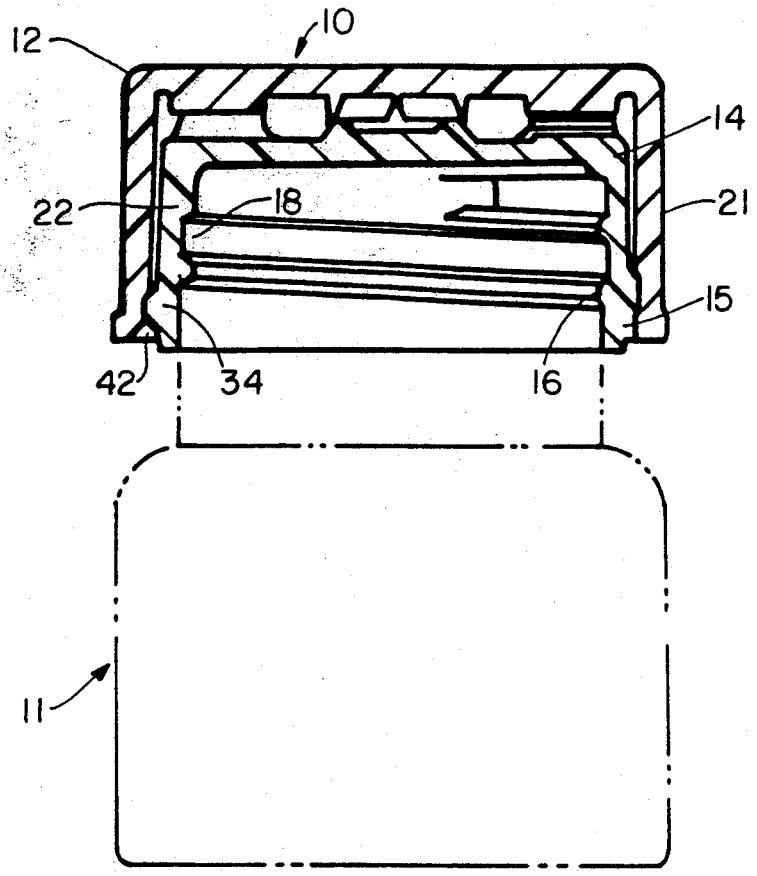
FIG. 1 is an elevational sectional view of a safety closure having nested inner and outer caps embodying the present invention.

Turning to the drawings (FIG. 1) there is shown a child-resistant, two-piece closure, generally indicated by 10, fastened to a container indicated generally by 11. The closure 10 includes an outer cap 12 having a skirt 21 depending therefrom overlying an inner cap 14, with the inner and outer caps being concentrically aligned. To fasten the closure to the container 11, a generally cylindrically shaped skirt 15 of the inner cap 14 is formed with a container fastening means such as a spiral screw thread 16 which cooperates with a corresponding shaped screw thread 18 on the container 11. Both the outer and the inner caps are preferably formed in single pieces by molding a relatively hard resilient plastic such as polypropylene.

Figure 8:
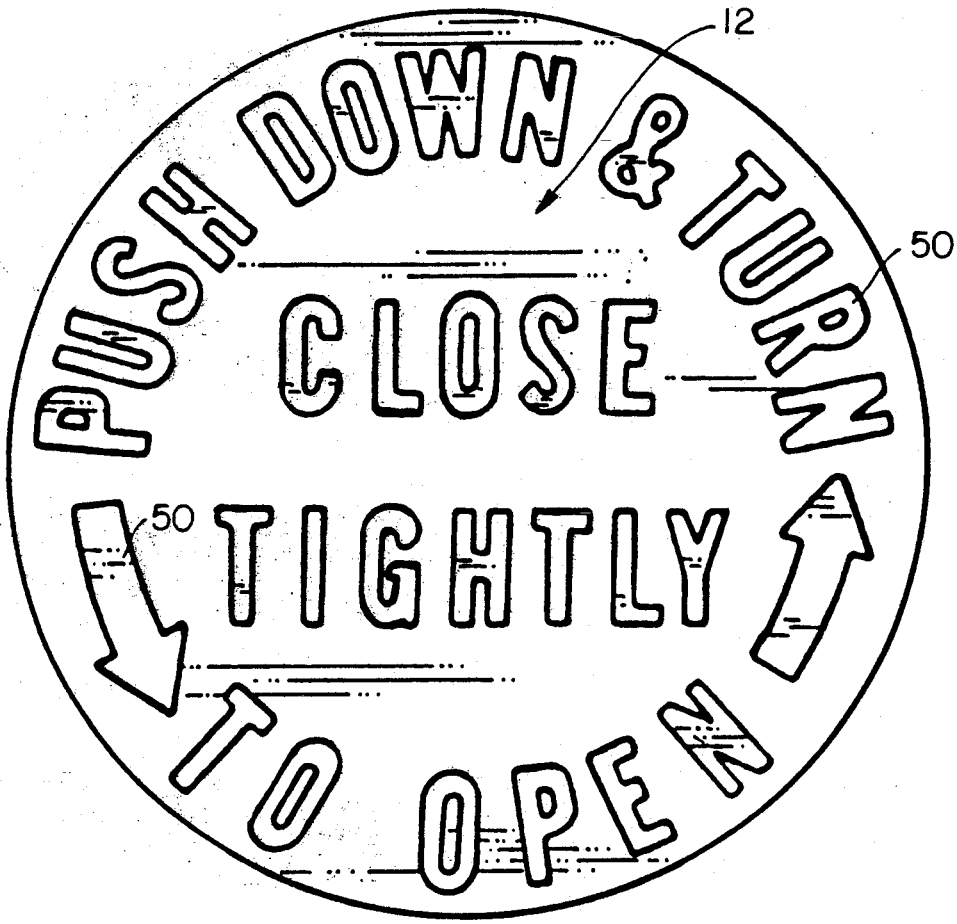
FIG. 8 is a top view of the outer cap member.

The outer cap member 12 is formed with a circular first top panel 28 (best see in FIG. 3) integrally molded with the depending skirt portion 20. Molded onto the underside of panel 28 and extending radially downwardly are a plurality of first ratchet teeth 24, as well as a plurality of spring tabs 36. Molded on the upper side of panel 28 may be indicia 50 detailing use of the closure assembly (see FIG. 8).

Figure 4:
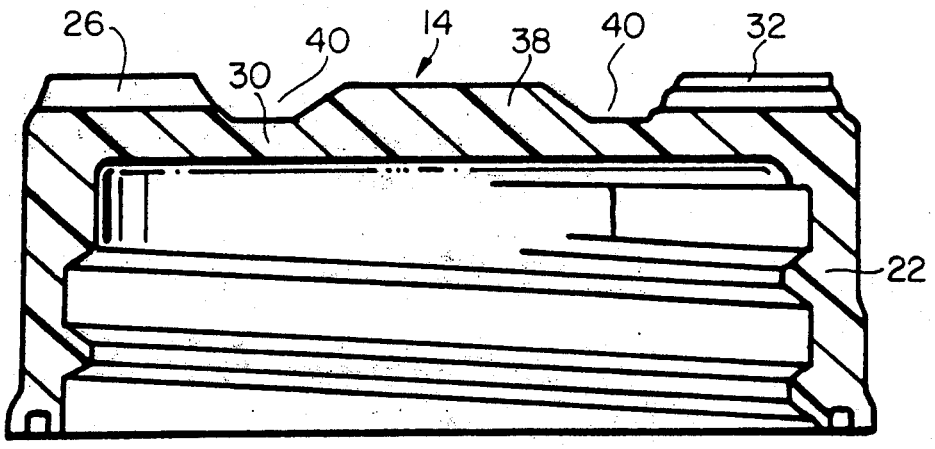
FIG. 4 is an elevational section view of the blank for the inner cap member of the closure.

The inner cap member 14 is formed with a circular second top panel 30 (best seen in FIG. 4) integrally molded with a depending skirt portion 22. Molded onto the topside of second panel 30 are a plurality of second ratchet teeth 26 interposed with a plurality of ramps 32, and a raised platform 38. Second ratchet teeth 26 are generally equally spaced from and angularly spaced about an axis through second panel 30, with a top wall of each of the teeth being generally perpendicular to the plane of the lower surfaces of the top end wall.

Figure 6:
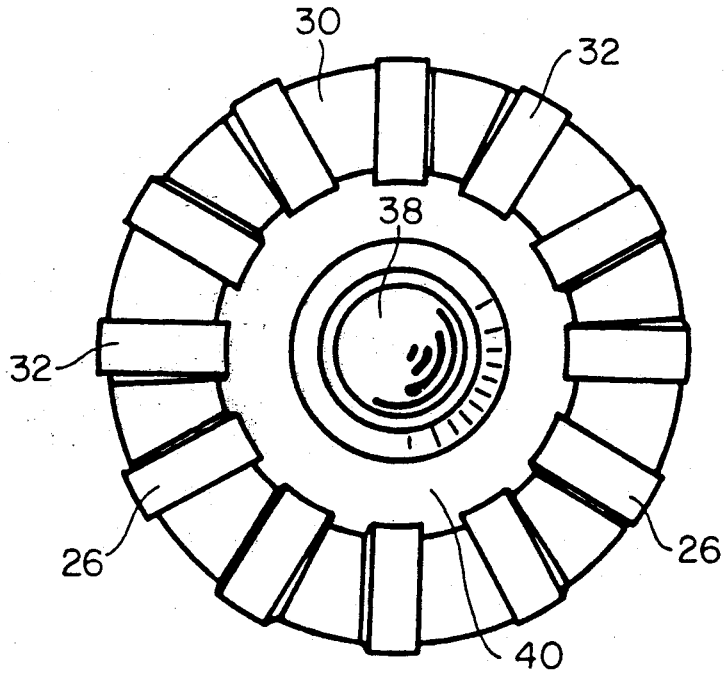
FIG. 6 is a plan view of the top of the inner cap member.

Second ratchet teeth 26 and ramps 32 are placed in alternating fashion (though, as will be obvious to those skilled in the art, need not be alternating) about the topside of second panel 30. A circular channel 40 (shown in section in FIG. 4, and best seen in FIG. 6) separates ratchet teeth 26 and ramps 32 from platform 38.

Turning back to FIG. 1, and particularly to inner cap member 14, a retention bead 34 is molded into the exterior surface of depending skirt 22. Retention bead 34 extends about the entire circumference of depending skirt 22 (though it need not do so) and is preferably of a diameter greater than that of a retention bead 42 formed in the depending skirt 20 of the outer cap member 12.

Closure 10 is formed by assembling the outer cap member 12 and the inner cap member 14. To assemble the completed closure 10, retention bead 42 of outer cap member 12 is forced over retention bead 34 of inner cap member 14, in the process causing depending skirt 20 of outer cap member 12 to spring outwardly slightly. Once the larger diameter retention bead 42 has passed over retention bead 34, depending skirt 20 springs back inwardly trapping the inner cap member 14 within the outer cap member 12.

Figure 7:
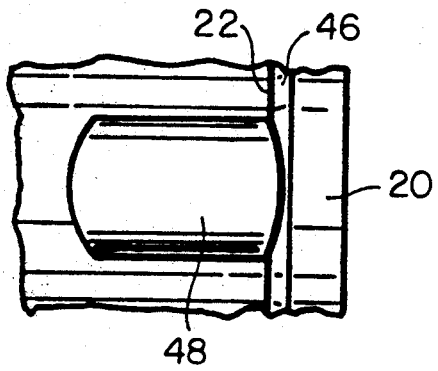
FIG. 7 is an enlarged view of the vent lugs used to assist in assembly of the closure.

As there is thereby formed an appreciable gap 46 between the interior of depending skirt 20 and the exterior of depending skirt 22, outer cap member 12 may rotate with respect to inner cap member 14. As will be appreciated by those skilled in the art, in order to provide venting during assembly of the inner and outer cap members, one or more vent lugs 48 are provided at regular intervals about skirt 22 of the inner cap member (see FIG. 7).

To apply the closure 10 by screwing the thread 16 of the inner cap 14 onto the cooperatively threaded portion 18 of the container 11 in the application direction (which is clockwise when viewed from the top of the closure in the drawings), first ratchet teeth 24 interlock with ramps 32. FIG. 9(*b*) illustrates the position of these elements during application of the closure.

Ramps 32 and second ratchet teeth 26 have different functions depending on whether the closure is being applied to the container (torquing) or being removed (untorquing). In other words, ramps 32 define both a low friction surface during undepressed counter-clockwise rotation of the closure and a contact area when torquing (clockwise rotation) the closure onto the container. As explained in more detail below, during the torquing operation first ratchet teeth 24 do not contact second ratchet teeth 26. Second ratchet teeth 26 do, however, define the contact area for untorquing (removal) of the closure member from the container when the outer cap member has been depressed.

It is an advantage of the present invention that, unlike in known closures, there is little, in fact negligible, back-ratcheting action or torque resulting when the undepressed closure is rotated in the counter-clockwise direction; back-ratchet torque which, if the closure is not relatively tightly screwed to the container, could result in undesired removal of the closure in known devices. Accordingly, a child who merely rotates the outer cap of the present invention in the removal direction should not be able to unscrew the closure from the container.

When viewed from above, first ratchet teeth 24 and ramps 32 are shaped in such a manner as to provide negligible reverse torque during undepressed counter-clockwise rotation of the outer closure. In particular, first ratchet teeth 24 are generally equally spaced from and angularly spaced about an axis through the center of first panel 28, with a top wall of each of the teeth being generally perpendicular to the plane of the upper surfaces of panel 28.

Figure 2:
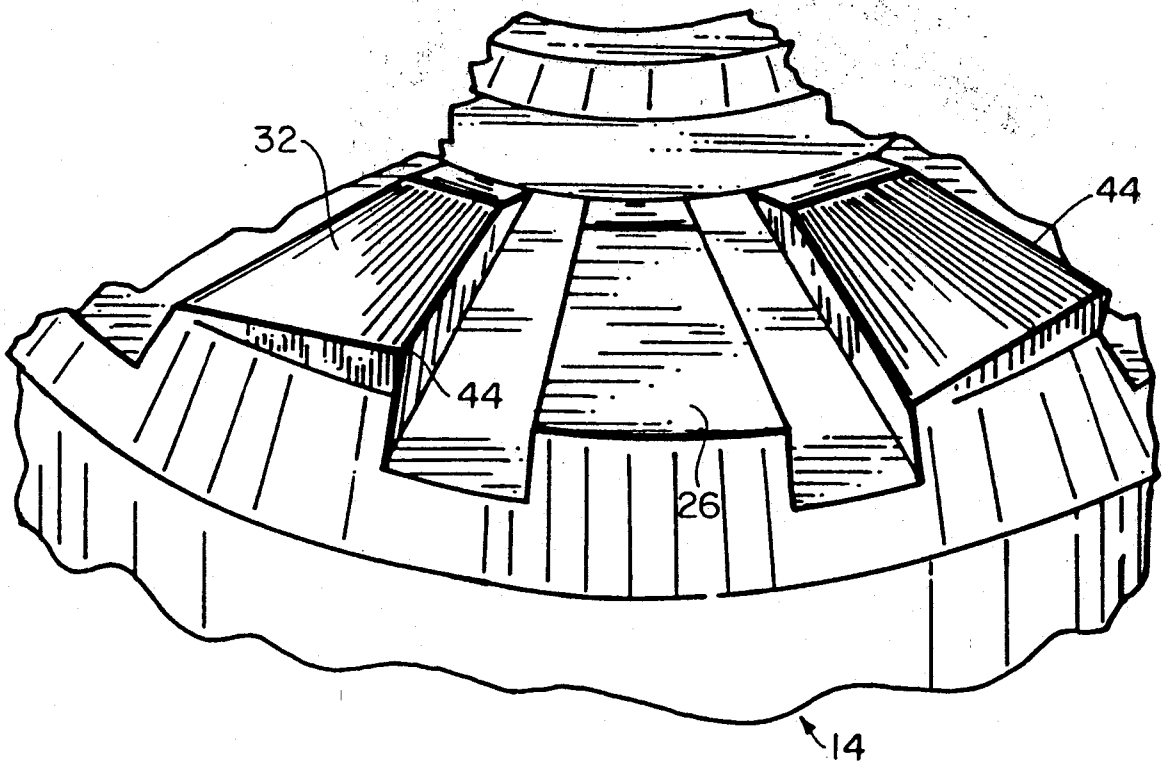
FIG. 2 is an enlarged fragmentary perspective view of the top of the inner cap member of the closure.

By contrast, radially arranged ramps 32 (see FIG. 2) have a helical contour, projecting upwardly from the upper surface of second panel 30 to an apex or highest point 44 of ramps 32. This contour allows a smooth, over-riding action between the contact parts (first ratchet teeth (24) and apex (44) of ramps (32)) when the undepressed closure 10 is rotated in the removal (counter-clockwise) direction. The resulting reverse torque, as assisted by the action of spring tabs 36 (as explained below), is insufficient to affect undesired removal of the closure.

The desired effect of negligible reverse torque is reinforced by the fact that first ratchet teeth 24 do not contact second ratchet teeth 26 during undepressed counter. clockwise rotation of the closure 10. To normally maintain the radially-extending teeth 24, 26 spaced apart from one another in the absence of any downwardly exerted pressure on the outer cap, spring tabs 36 contact platform 38, which stresses tabs 36 and provides a restoring force to lift the teeth 24, 26 apart when the manually exerted downward force is released.

Figure 5:
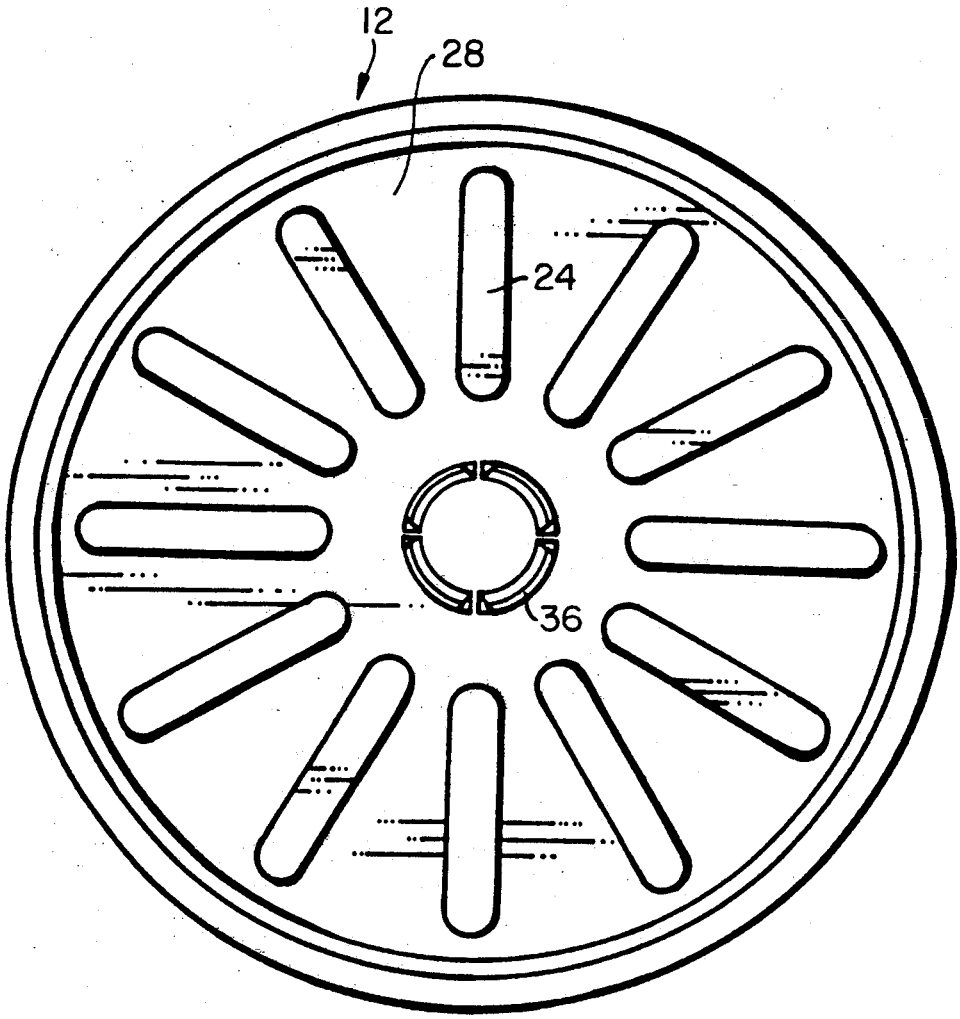
FIG. 5 is a bottom view of the outer cap member.

Spring tabs 36 take the form of tabs integrally molded with the underside of the top panel. The spring tabs 36 extend radially inwardly with respect to the vertical axis of the outer cap 12; and their angle of inclination may be varied so long as the teeth 24, 26 are, as described herein, held apart. The shape and/or the number of spring tabs 36 effect the vertical placement of the outer and inner cap members 14 and 16, respectively, and the amount of force required to depress the outer cap member 14 for removal of the closure 10. The embodiment illustrated (FIG. 5) shows four spring tabs 36, but more or less than four tabs may be employed if desired.

As will be understood by those skilled in the art, it is important that the restorative force caused by spring tabs 36 not be so great as to completely separate first ratchet teeth 24 from ramps 32. That is, spring tabs 36 also serve as a spacing mechanism for the vertical placement of the outer cap part 12 relative to the inner cap part 14.

As illustrated in FIG. 9(*a*), the at rest position for the closure is a clearance position wherein the relevant contact positions (for purposes of effecting back ratchet torque) between the outer and inner cap members are at the contact of spring tabs 36 with platform 38 and at the contact point of apex 44 of ramps 32 and the first ratchet teeth 24.

As illustrated in FIG. 9(*c*), to remove the closure 10 from the container 11 it is necessary to press downwardly on the outer cap 12 and simultaneously apply a torque on the outer cap skirt 20 in the removal direction. With downward pressure of sufficient magnitude applied to the outer cap 12, first ratchet teeth 24 are in interlocking engagement with second ratchet teeth 26. With the respective radially-extending teeth 24, 26 engaged or meshed together, a torque applied to the outer cap skirt 26 in the removal direction causes a similar torque to be translated through the engaged teeth to the inner cap 14 which then unscrews its thread 16 (and hence the closure) from the container thread 18.

Thus, it can be seen that an improved closure with negligible back-ratchet torque during operation in an undepressed condition is provided by the present invention. While a preferred embodiment of the invention has been shown and described herein, there is no intent to limit the invention by this description. On the contrary, the invention is intended to cover all modifications and alternatives falling within the scope of the accompanying claims.

I claim:

1. A child-resistant closure for sealing an open-topped container having an external screw thread formed on the neck of the container, the closure comprising:

an outer cap having a firs top end wall and a first skirt depending from the outer edge thereof;

an inner cap having a second top end wall and an internally threaded second skirt depending from the outer edge thereof for engagement with the external screw thread on the container, the outer cap overlying the inner cap and being concentric therewith;

first ratchet teeth on a lower face of the first top end wall of the outer cap abutting with ramp members on the upper face of the second top end wall of the inner cap when the outer cap is turned in the application direction to rotate the two caps together for causing the internal threads on the inner cap to cooperate with the external screw threads on the container to fasten the closure on the container;

the first ratchet teeth on the upper cap member abutting with second ratchet teeth on the inner cap member only when a downward force and a torque are simultaneously applied on the outer cap member to release the closure from the container;

the first ratchet teeth on the outer cap member sliding up and over the ramp members on the inner cap members with negligible back-ratchet torque when the outer cap member is turned in the removal direction without the application of a downward force on the outer cap member; and the inner cap member being captive within the outer cap member; a resilient member disposed between said cap members such that a space is formed therebetween.

2. The closure of claim 1 wherein:

said first ratchet teeth are generally equally spaced from and angularly spaced about an axis through the center of said first top end wall; and a top wall of each of said first ratchet teeth being generally perpendicular to a plane formed by a lower surface of said first top end wall.

3. The closure of claim 1 wherein:

said second ratchet teeth are generally equally spaced about an axis through the center of said second top end wall; and a top wall of each of said second ratchet teeth being generally perpendicular to a plane formed by an upper surface of said second top end wall.

4. The closure of claim 1 wherein said second ratchet teeth and said ramps are placed in alternating fashion about an upper surface of said second top end wall.

5. The closure of claim 1 wherein said ramps define both a low friction surface during undepressed counter-clockwise rotation of the closure and a contact area during clockwise rotation of the closure.

6. The closure of claim 1 wherein said second ratchet teeth define a contact area for removal of the closure member from the container when the outer cap has been depressed.

7. The closure of claim I wherein said ramps are radially arranged and have a helical contour projecting upwardly from an upper surface of said second top end wall to an apex.

8. The closure of claim 1 wherein said first ratchet teeth do not contact said second ratchet teeth during undepressed counter-clockwise rotation of said outer cap.

9. The closure of claim 1, further comprising:

at least one spring tab extending axially downwardly from a lower face of said first top end wall; and a raised platform extending upwardly from an upper face of said second top end wall.

10. The closure of claim 9 wherein in the absence of any downwardly exerted pressure on said outer cap, said spring tabs contact said platform, which stresses said spring tabs and provides a restoring force to separate said first and second ratchet teeth when the downward force is released.

11. The closure of claim 10 wherein said spring tabs also serve as a spacing mechanism for the vertical placement of said outer cap relative to said inner cap.

12. The closure of claim 9 wherein the on at rest position for the closure is a clearance position wherein contact positions between said outer and inner caps are at a first contact point of said spring tabs with said platform and at a second contact point at an apex of said ramps and said first ratchet teeth.

* * * * *